US010107600B2

(12) United States Patent
Atluri et al.

(10) Patent No.: US 10,107,600 B2
(45) Date of Patent: Oct. 23, 2018

(54) DEVICE CONFIGURATION TO PROVIDE GUNNERY TRAINING AND METHOD OF ASSEMBLY

(71) Applicant: ZEN TECHNOLOGIES LIMITED, Hyderabad (IN)

(72) Inventors: Kishore Dutt Atluri, Hyderabad (IN); Ravi M. Kumar, Hyderabad (IN)

( * ) Notice: Subject to any disclaimer, the term of this patent is extended or adjusted under 35 U.S.C. 154(b) by 180 days.

(21) Appl. No.: 15/029,263

(22) PCT Filed: Oct. 16, 2014

(86) PCT No.: PCT/IB2014/065368
§ 371 (c)(1),
(2) Date: Apr. 14, 2016

(87) PCT Pub. No.: WO2015/056212
PCT Pub. Date: Apr. 23, 2015

(65) Prior Publication Data

US 2016/0238353 A1 Aug. 18, 2016

(30) Foreign Application Priority Data

Oct. 15, 2013 (IN) ..... 4437/CHE/2013

(51) Int. Cl.
*F41A 33/00* (2006.01)
*F41J 7/06* (2006.01)
(Continued)

(52) U.S. Cl.
CPC . *F41J 7/06* (2013.01); *F41J 1/10* (2013.01); *F41J 2/00* (2013.01)

(58) Field of Classification Search
USPC ..... 434/11, 16, 19, 23; 273/406, 407
See application file for complete search history.

(56) References Cited

U.S. PATENT DOCUMENTS 3,515,388 A * 6/1970 Zachmeier ..... F41J 7/06 273/406
4,288,080 A * 9/1981 Laporte ..... F41J 7/06 273/406

(Continued)

*Primary Examiner* — Kurt Fernstrom
(74) *Attorney, Agent, or Firm* — James M. Smedley LLC; James Michael Smedley, Esq.

(57) ABSTRACT

The present disclosure relates to firearm or gunnery training system. More particularly relates to a device and method for providing multiple movements of a target for firearm or gunnery practice. The device (20) comprising a frame unit (8) configured to accommodate a drive mechanism (28), which is configured to rotate a first shaft (1) within a first predetermined range of angle. The frame unit (8) comprises more than one face and at least one of the faces is configured as a base for the device (20). The device (20) further comprises a target holding bracket (6) removably connectable to a target (10) at one end (6*a*) and a holder mating block (5) at other end (6*b*). Also, an eccentric target holder (3) is removably connectable to the first shaft (1) at a first end (3*a*) and a holder mating block (5) at a second end (3*b*). The second end (3*b*) of the eccentric target holder (3) comprises one or more slots (3*c*) such that the holder mating block (5) is placed in any one of the one or more slots (3*c*) for orienting plane of the target (10) in at least one of parallel and perpendicular to the first shaft (1).

19 Claims, 18 Drawing Sheets

Figure 1A:
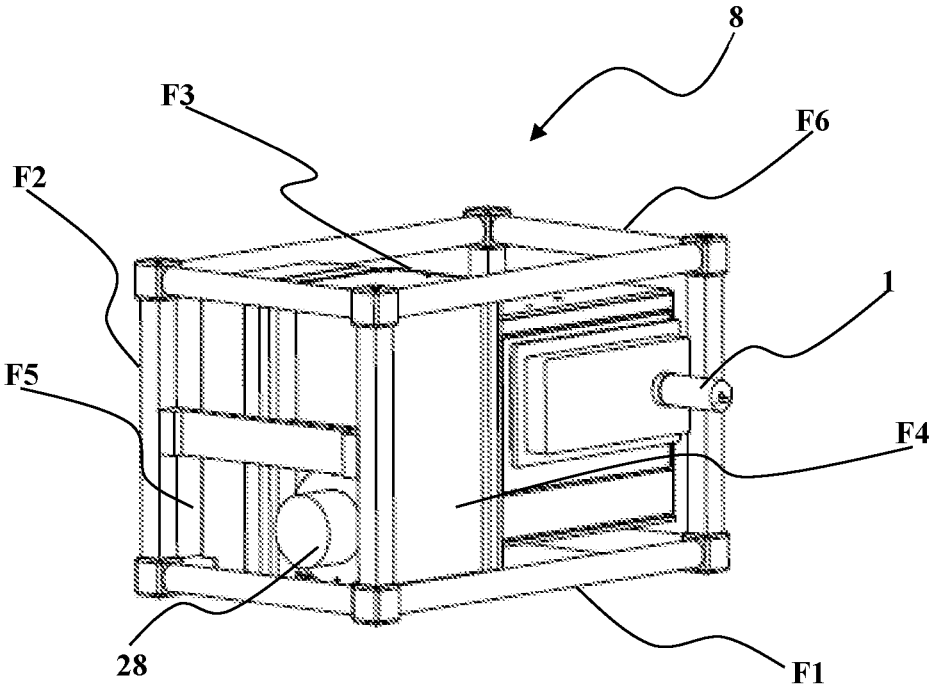

(51) Int. Cl.
*F41J 2/00* (2006.01)
*F41J 1/10* (2006.01)

(56) References Cited

U.S. PATENT DOCUMENTS

| | | | | | |
|---|---|---|---|---|---|
| 5,067,683 | A * | 11/1991 | Wager | F41J 1/10 | 248/156 |
| 5,433,451 | A * | 7/1995 | De Vries | F41J 7/04 | 273/392 |
| 5,549,208 | A * | 8/1996 | Yurga | A47F 5/0884 | 211/207 |
| 5,868,394 | A * | 2/1999 | Garland | F41J 1/10 | 273/386 |
| 5,934,678 | A * | 8/1999 | Theissen | F41J 7/06 | 273/386 |
| 6,761,357 | B2 * | 7/2004 | Witt | F41J 1/10 | 273/407 |
| 7,950,667 | B2 * | 5/2011 | Shum | F41J 7/06 | 273/406 |
| 8,955,846 | B2 * | 2/2015 | Frickey | F41J 1/10 | 248/183.1 |
| 9,612,092 | B2 * | 4/2017 | Chester | F41J 7/04 | |
| 2006/0240388 | A1 * | 10/2006 | Marshall | F41J 1/10 | 434/19 |

* cited by examiner

Magnified view of 'A'

DEVICE CONFIGURATION TO PROVIDE GUNNERY TRAINING AND METHOD OF ASSEMBLY

TECHNICAL FIELD

The present disclosure broadly relates to a training system. More particularly relates to a device and method for providing multiple movements of a target for gunnery practice.

BACKGROUND OF THE DISCLOSURE AND PRIOR ARTS

Military education and training is a process which intends to establish and improve the capabilities of military personnel in their respective roles. Before any person gets authorization to operate technical equipment or be on the battlefield, they must undergo basic training and advanced training. In the advanced training, military technology and equipment is taught. Also, there are various equipment and field training provided during the advanced training. In the field training, one of the training includes a target shooting training. The target shooting training includes real-time shooting or firing activities on targets. The shooting or firing activities are carried-out in various ways on target systems. The target systems are used for training of trainee or shooters and there exists various target systems, of which, few are as provided below.

One prior art target system includes a stationary target. In this type of target system, an image of a target is raised in front of the trainee for practice. The target being stationary, it would be visible to the trainee all the times. This target system does not provide any real-time, decisional requirement as to the threat status of the target to the trainee during training.

Another target system includes a moveable target. One such movable target is provided by placing a target image on a hanger and moved using a driver such as cable. Thus, the feature of movable target from one place to other place is introduced. The movement is carried-out in directions towards and away from the trainee. Though the advantage of mobility at various positions, (towards and away from the trainee) is provided; this target system still has a disadvantage of any real-time, decisional requirement as to threat status of the target to the trainee during training.

In another target system, the target image is rotated towards or away from trainee. Initially the target image is hidden from view of the target (0 degrees of rotation) and thereafter the target image is rotated to face the trainee (90 degrees from initial position). Even though this target system provide some kind of simulation other than the stationary or moving targets, the target in this system is rotated in only fixed direction and angle. Thus, the trainees anticipates the rotation and wait for rotate to happen and can easily focus on the target and therefore, the target system does not provide any decisional requirement as to the threat status of the target.

Another kind of target system includes complex frames to provide stability to the target system during usage. The frames usually require assembling and disassembling before and after use respectively. Also, the system needs regular adjustments depending on the surface on which they are placed. Thus, these types of target system are difficult to transport and deploy in the field for training. Thus, the target system would have limitations by way of specific locations and environments in which they are installed, and the possible arrangements of targets available.

Another kind of target system includes a method of providing a mobile target system which provides dynamic moving target to simulate lifelike movements and give the trainee simulation of real close quarter's firearms engagement. However, the target system does not provide a target system in which the target can be simulated in plurality of possible directions/orientations.

Thus, the existing gunnery training or target training systems provides different modes of target movements by changing the clamp position and clamp components, but they suffer from one or more disadvantages include less portability, relative complexity, larger, Also, they are limited in terms of the types of locations and environments they can provide for shooters/trainees and possible arrangements of targets. In addition, for providing different movements of the targets by changing various target clamping components, the target is placed and fixed using different target holding brackets for each movement or positions.

It is therefore desirable to have a device and an associated method thereof that would overcome the shortcomings or at least substantially ameliorate the shortcomings and disadvantages of the conventional target training systems.

SUMMARY OF THE DISCLOSURE

The shortcomings of the prior art are overcome and additional advantages are provided through the present disclosure. Additional features and advantages are realized through the techniques of the present disclosure. Other embodiments and aspects of the disclosure are described in detail herein and are considered a part of the claimed disclosure.

In one embodiment, the present disclosure provides for a device configured to provide gunnery training. The device comprising a frame unit configured to accommodate a drive mechanism which is but not limited to, "rack and pinion mechanism", "slider-crank mechanism", "magnetic drive mechanism", "planetary gears" and "worm gears". Drive mechanism is configured to rotate a first shaft within a first predetermined range of angle, wherein the frame unit comprises more than one face and at least one of the faces is configured as a base for the device. The device further comprises at least one target holding bracket removably connectable to at least one target at one end and a holder mating block at other end. At least one eccentric target holder is removably connectable to the first shaft at a first end and at least one holder mating block at a second end. The second end of the at least one eccentric target holder comprises one or more slots in a predetermined pattern, such that the holder mating block is placed in any one of the one or more slots for orienting plane of the at least one target in at least one of parallel and perpendicular to the first shaft for gunnery training.

In one embodiment, a first face of the at least one of the face of the frame unit acts as a base of the device when axis of the holder mating block is perpendicular to the axis of the first shaft and plane of the target is parallel to the axis of the first shaft.

In one embodiment, a first face of the at least one of the face of the frame unit acts as a base of the device when axis of the holder mating block and plane of the target are perpendicular to the axis of the first shaft.

In one embodiment, a second face of the at least one of the face of the frame unit acts as a base of the device when axis of the holder mating block and plane of the target are parallel to the axis of the first shaft.

In one embodiment, a second shaft is configured in the frame unit, which is parallely connected to the first shaft, such that the first shaft drives the second shaft for rotating the second shaft for an angle greater than the first predetermined range of angle.

In one embodiment, the first shaft and the second shaft are connected to each other by means selected from a group comprising toothed belts, chains, links and gears for obtaining slipless transmission between the first shaft and second shaft, wherein the means avoid slippage between the first shaft and second shaft while in operation.

In one embodiment, a second face of the at least one of the face of the frame unit acts as a base of the device when the target is fixed to the second shaft using a removably connectable concentric target holder and axis of the holder mating block and plane of the target are co-axial with the axis of second shaft.

In one embodiment, the one or more slots are perpendicular and intersecting to each other.

In one embodiment, the present disclosure also provides for a method of assembling the device. The method comprising acts of providing a frame unit to accommodate a drive mechanism which is but not limited to, "rack and pinion mechanism", "slider-crank mechanism", "magnetic drive mechanism", "planetary gears" and "worm gears". Drive mechanism is configured to rotate a first shaft within a first predetermined range of angle. The frame unit comprises more than one face and at least one of the faces is configured as a base for the device. The method further comprises removably connecting at least one target holding bracket to at least one target at one end and a holder mating block at other end. After fixing the at least one target with the at least one target holding bracket, the at least one eccentric target holder is removably connected to the first shaft at a first end and at least one holder mating block at a second end. The second end of the at least one eccentric target holder comprises one or more slots in a predetermined pattern, such that the holder mating block is placed in any one of the one or more slots for orienting plane of the at least one target in at least one of parallel and perpendicular to the first shaft for gunnery training.

In one embodiment, the target is fixed to the second shaft using at least one concentric target holder.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The features of the present disclosure will become more fully apparent from the following description and appended claims, taken in conjunction with the accompanying drawings. Understanding that these drawings depict only several embodiments in accordance with the disclosure and are therefore, not to be considered limiting of its scope. The disclosure will be described with additional specificity and detail through use of the accompanying drawings.

FIG. 1*a* shows a perspective view of a frame unit comprising drive mechanism with a first shaft according to an embodiment of the present disclosure.

Figure 1B:
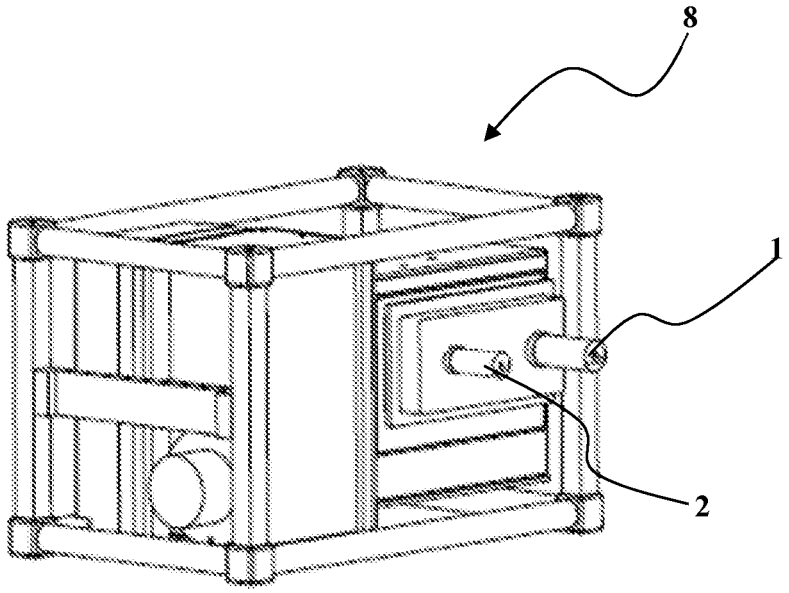

FIG. 1*b* shows a perspective view of a frame unit comprising drive mechanism with a first shaft and a second shaft connected to the first shaft according to an embodiment of the present disclosure.

Figure 2A:
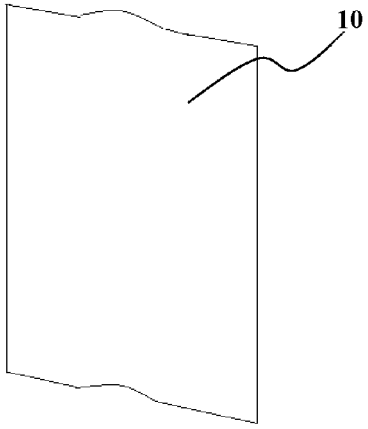
Figure 2B:
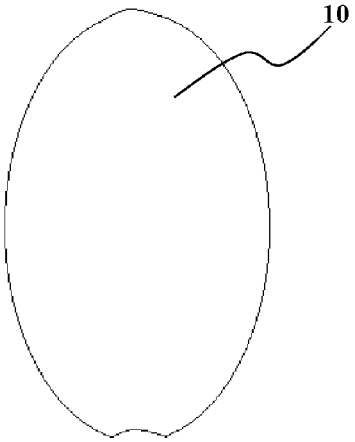

FIGS. 2*a* and 2*b* shows a perspective view of targets according to an embodiment of the present disclosure.

Figure 3:
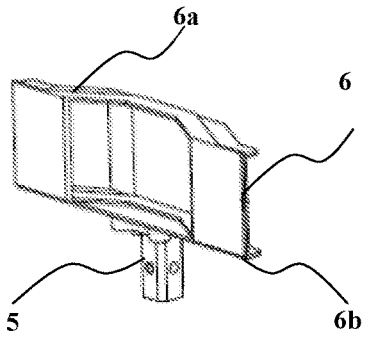

FIG. 3 shows a perspective view of an assembled view of a target holding bracket and holder mating block according to an embodiment of the present disclosure.

Figure 4A:
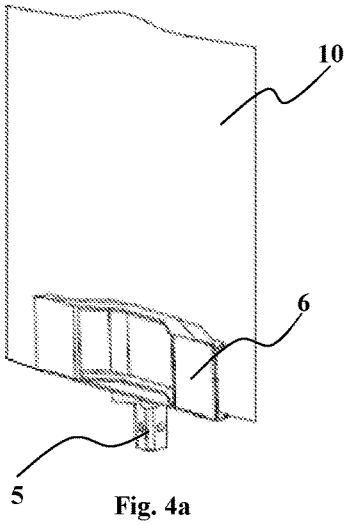
Figure 4B:
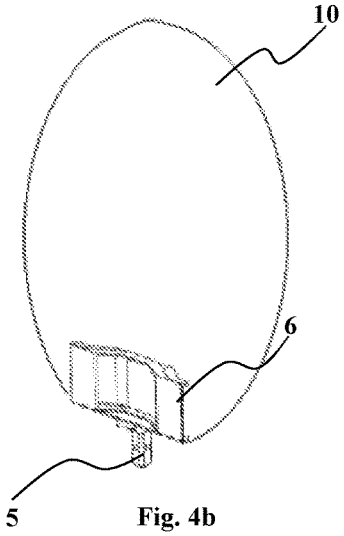

FIGS. 4*a* and 4*b* shows a perspective view of an assembled view of the at least one target removably connected with the target holding bracket according to an embodiment of the present disclosure.

Figure 5A:
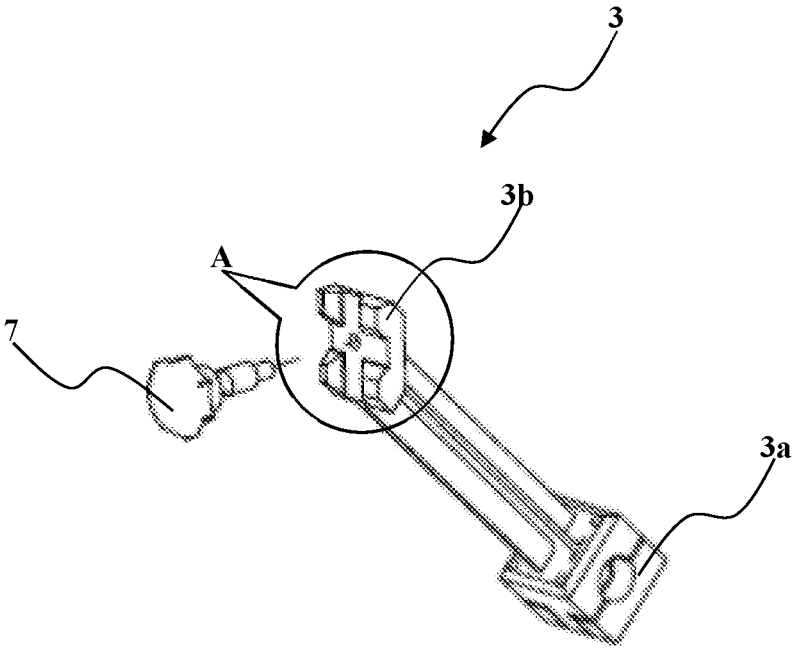

FIG. 5*a*: shows a perspective view of an eccentric target holder according to an exemplary embodiment of the present disclosure.

Figure 5B:
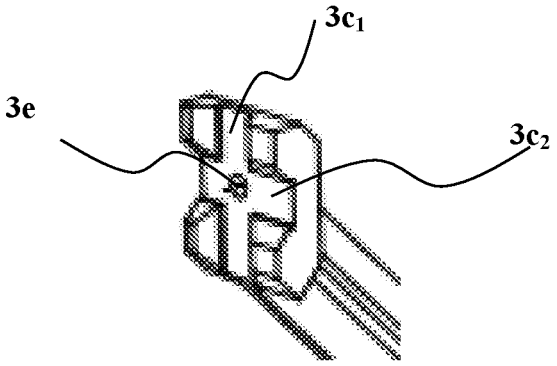

FIG. 5*b*: shows a magnified view of the portion "A" indicated in FIG. 5*a*.

Figure 6:
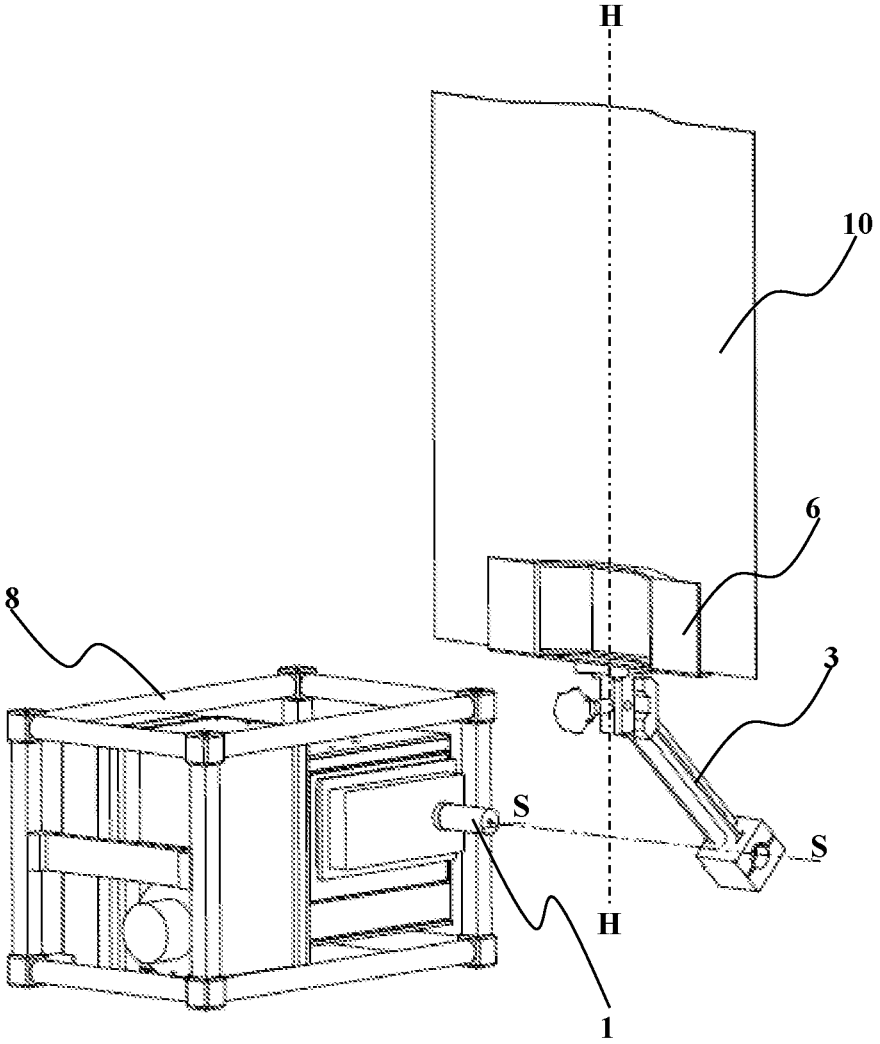

FIG. 6: shows a perspective view of the device comprising first shaft in an exploded view according to an embodiment of the present disclosure.

Figure 7:
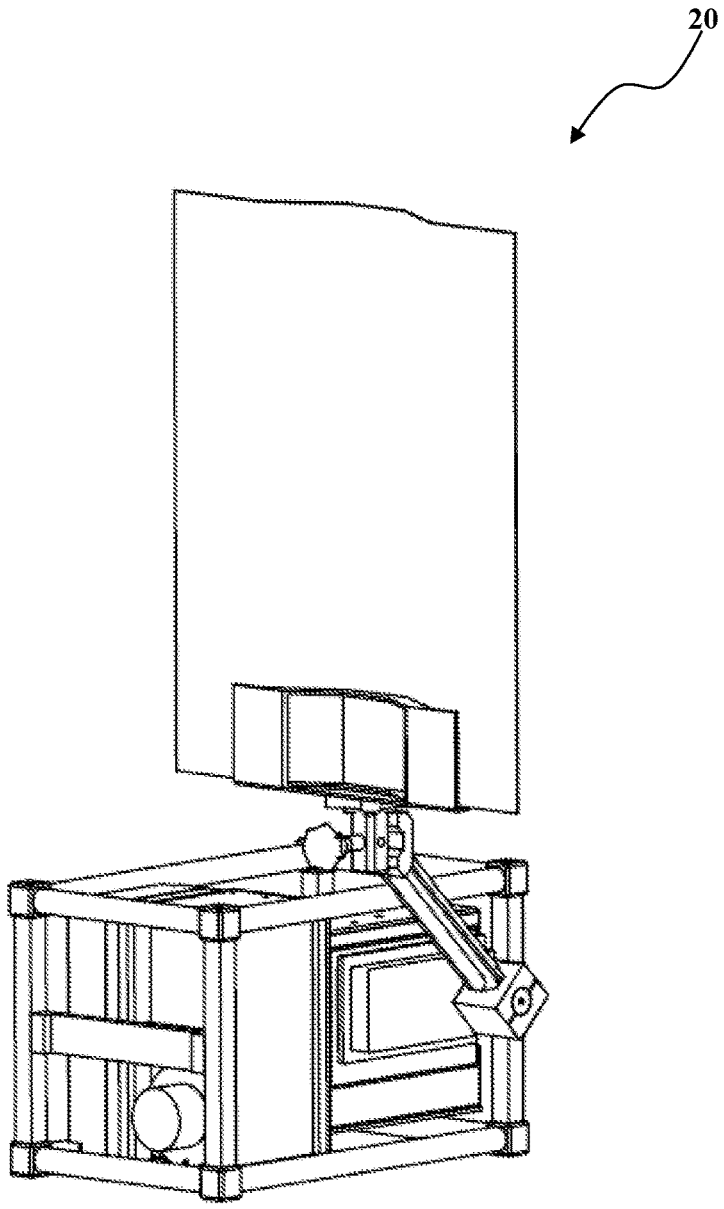

FIG. 7: shows a perspective view of the device in FIG. 6 in an assembled view.

FIGS. 7*a* to 7*d*: shows perspective, front and side views of an embodiment of the device when target is fixed to the first shaft using an eccentric target holder and a first face of the at least one of the faces of the frame unit acts as a base of the device, and axis of the holder mating block is perpendicular to the axis of the first shaft and plane of the target is parallel to the axis of the first shaft according to an embodiment of the present disclosure.

Figure 8A:
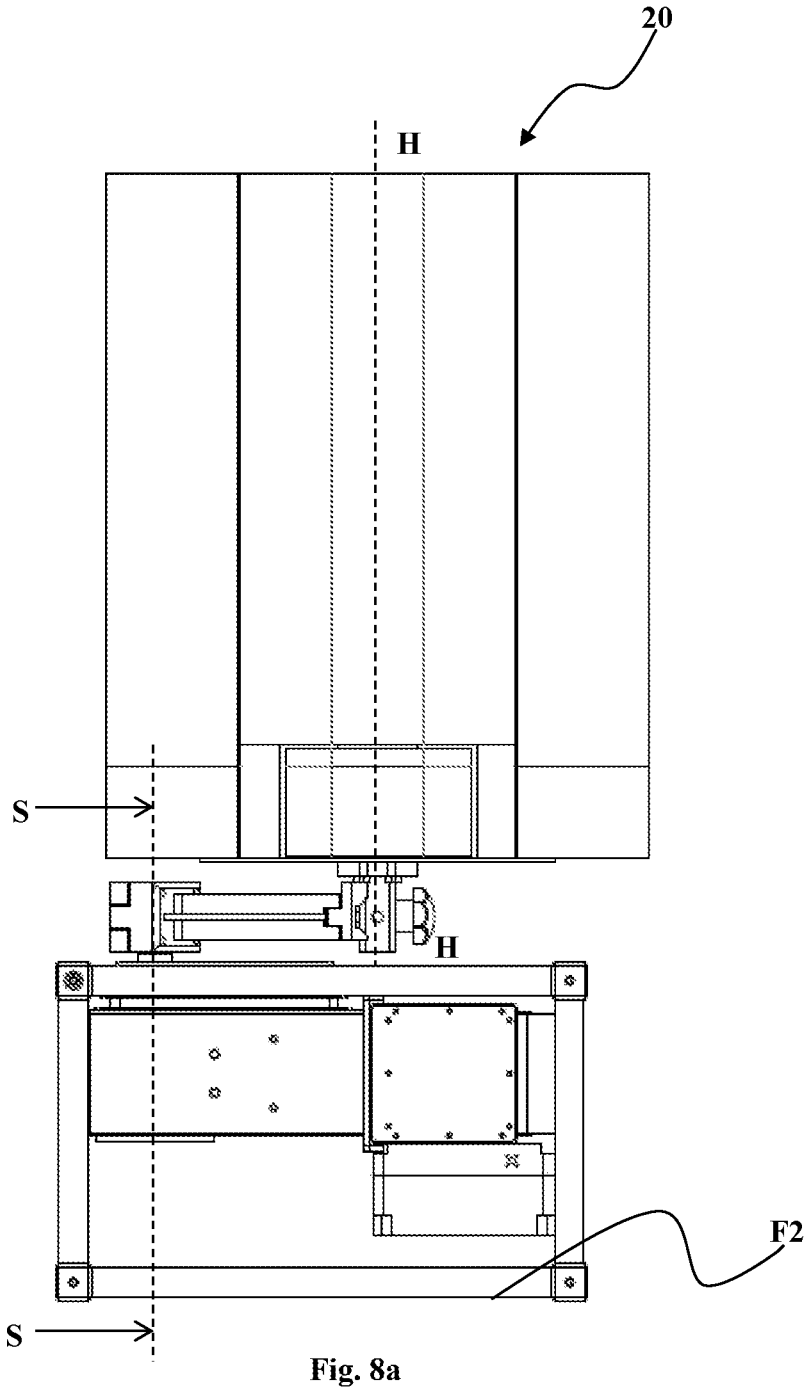
Figure 8B:
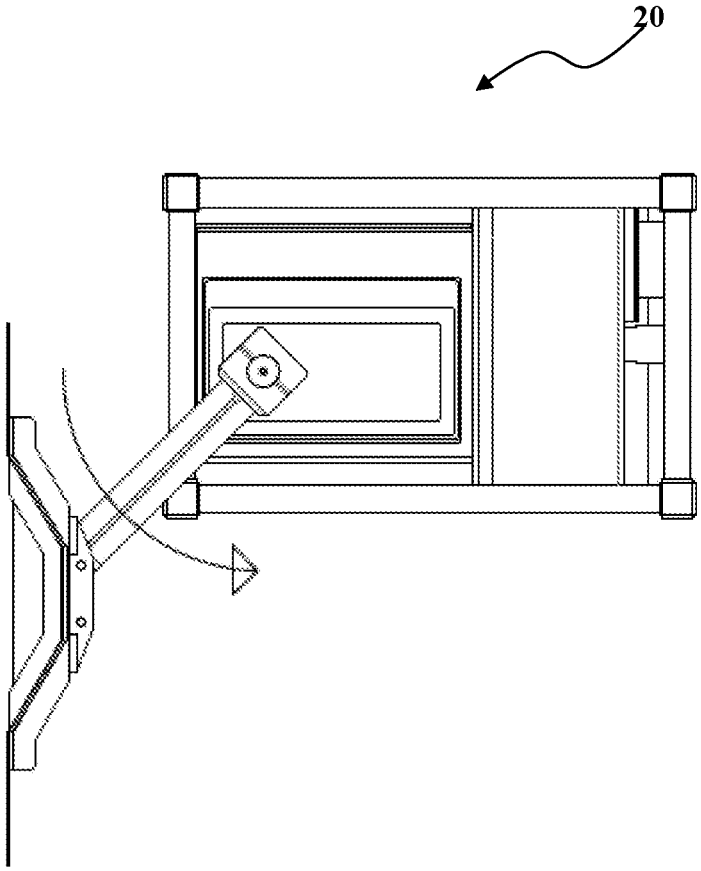
Figure 8C:
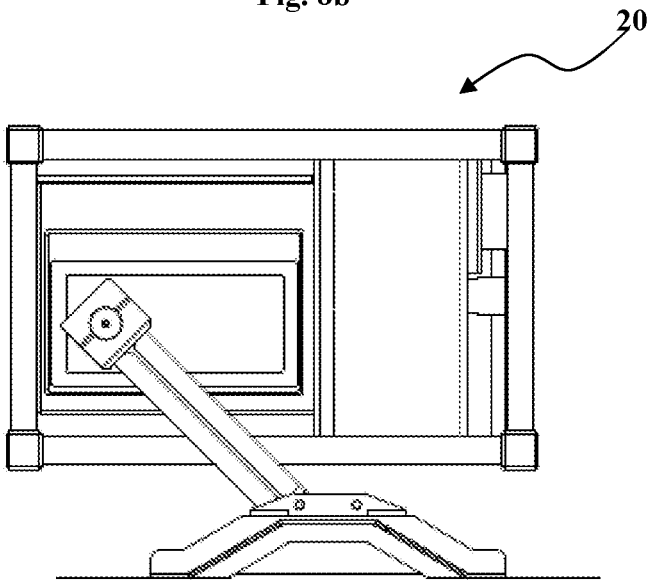

FIGS. 8*a* to 8*c*: shows front and top views of an embodiment of the device when the target is fixed to the first shaft using the eccentric target holder and a second face of the at least one of the faces of the frame unit acts as a base of the device, and axis of the holder mating block and plane of the target are parallel to the axis of the first shaft according to an embodiment of the present disclosure.

Figure 9A:
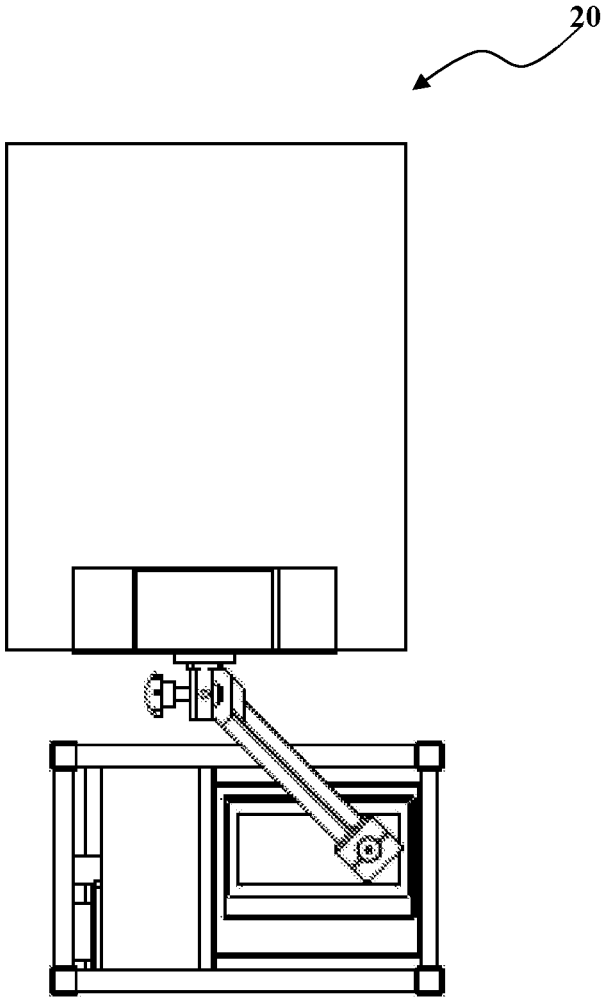
Figure 9B:
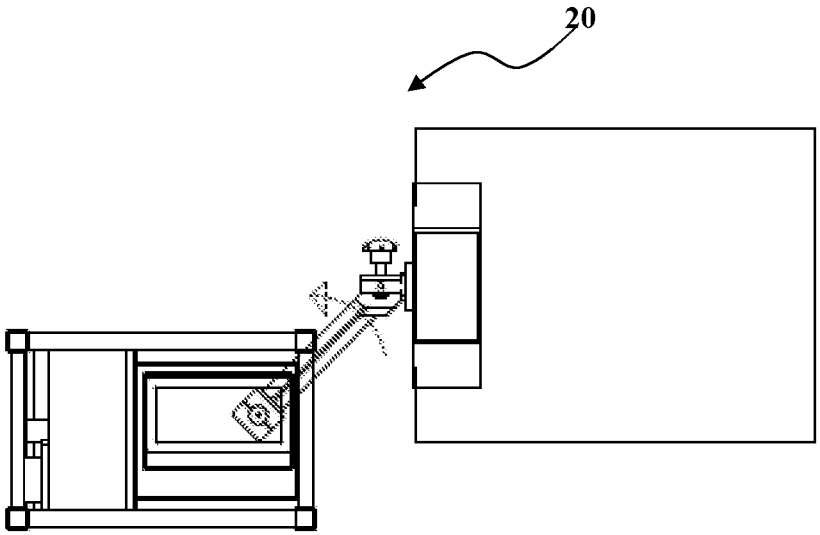
Figure 9C:
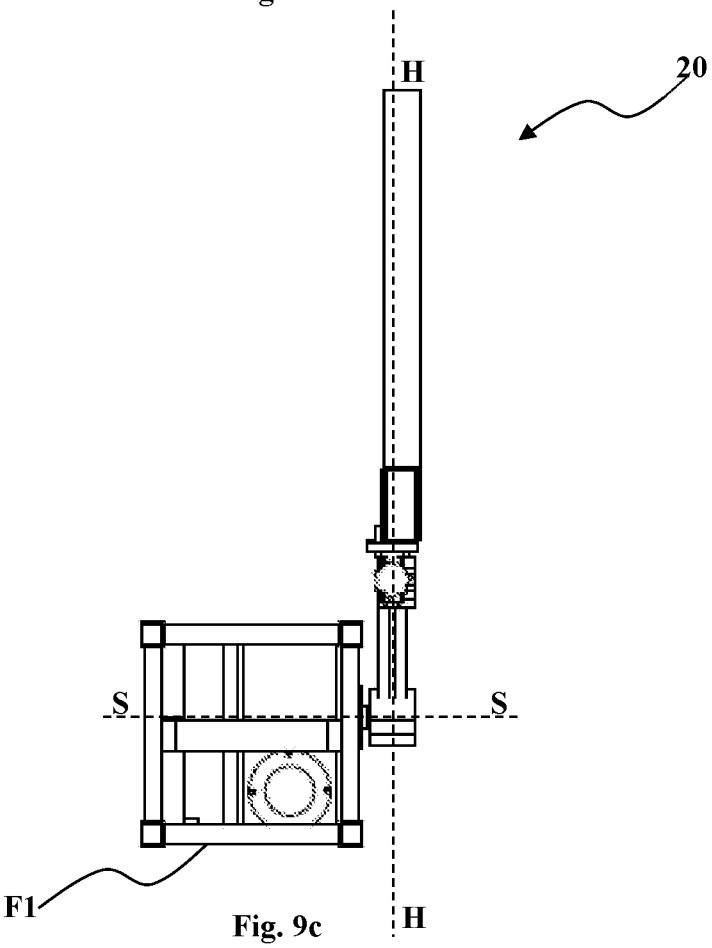

FIGS. 9*a* to 9*c* shows front views and a side view of an embodiment of the device when target is fixed to the first shaft using the eccentric target holder and a first face of the at least one of the faces of the frame unit acts as a base of the device, and axis of the holder mating block and plane of the target are perpendicular to the axis of the first shaft according to an embodiment of the present disclosure.

Figure 10A:
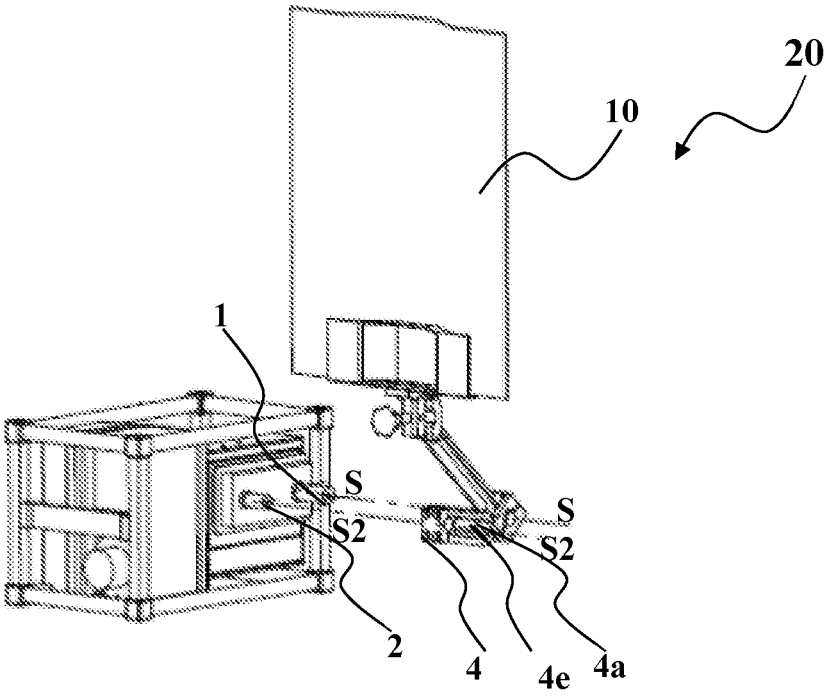

FIG. 10*a*: shows a perspective view of the device in an exploded view, wherein the device further comprises a second shaft parallel to the first shaft according to an exemplary embodiment of the present disclosure.

Figure 10B:
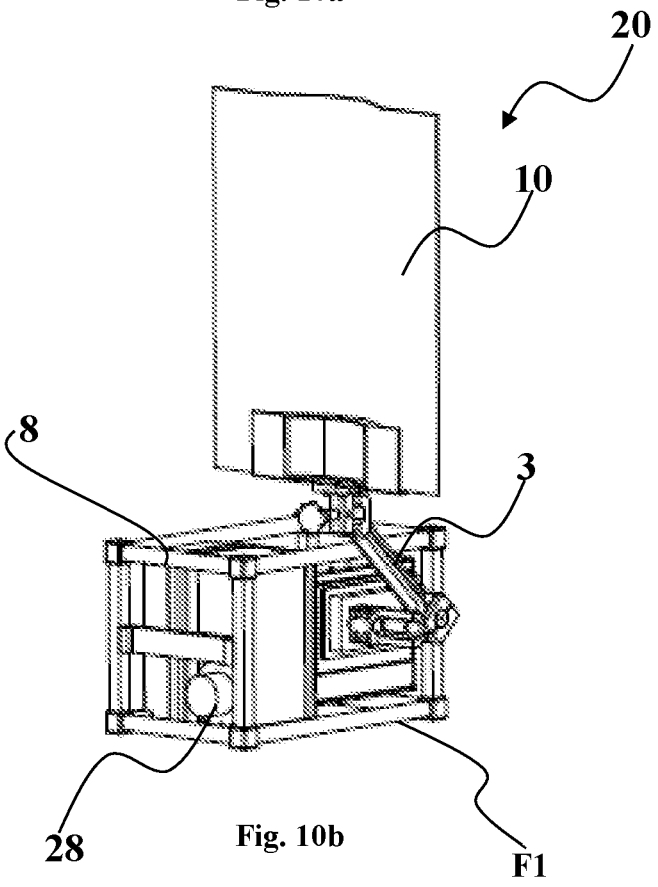

FIG. 10*b* shows a perspective view of the device in FIG. 10*a* in an assembled view according to an exemplary embodiment of the present disclosure.

FIGS. 11*a* to 11*d* show various views of an embodiment of the device when the target is fixed to the second shaft using a removably connectable concentric target holder and a second face of the at least one of the faces of the frame unit acts as a base of the device and axis of the holder mating block and plane of the target are co-axial with the axis of second shaft.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE DISCLOSURE

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, and designed in a wide variety of different configurations, all of which are explicitly contemplated and make part of this disclosure.

REFERRAL NUMERALS

| Referral numbers | Description |
|---|---|
| 1 | First shaft |
| 2 | Second shaft |
| 3 | Eccentric target holder |
| 3a | First end of the eccentric target holder |
| 3b | Second end of the eccentric target holder |
| 3c | Slots in the second end |
| $3c_1$ | Horizontal slot |
| $3c_2$ | Vertical slot |
| 3e | Threaded hole of the Second end of the eccentric target holder |
| 4 | Concentric target holder |
| 4a | Slot of Concentric target holder |
| 4e | Threaded hole of the Concentric target holder |
| 5 | Holder mating block |
| 6 | Target holding bracket |
| 6a | First end of the bracket connecting to the target |
| 6b | Second end of the bracket connecting to the holder mating block |
| 7 | Knob |
| 8 | Frame unit |
| 10 | Target |
| 20 | Device |
| 28 | Drive mechanism |
| H-H | Axis of the holder mating block |
| S-S | Axis of the first shaft |
| S2-S2 | Axis of the second shaft |

In one embodiment, the present disclosure provides for a device configured to provide gunnery training. The device comprising a frame unit configured to accommodate a drive mechanism which is but not limited to, "rack and pinion mechanism", "slider-crank mechanism", "magnetic drive mechanism", "planetary gears" and "worm gears". The drive mechanism is configured to rotate a first shaft within a first predetermined range of angle, wherein the frame unit comprises more than one face and at least one of the faces is configured as a base for the device. The device further comprises at least one target holding bracket removably connectable to at least one target at one end and a holder mating block at other end. At least one eccentric target holder is removably connectable to the first shaft at a first end and at least one holder mating block at a second end. The second end of the at least one eccentric target holder comprises one or more slots in a predetermined pattern, such that the holder mating block is placed in any one of the one or more slots for orienting plane of the at least one target in at least one of parallel and perpendicular to the first shaft for gunnery training.

In one embodiment, a first face of the at least one of the faces of the frame unit acts as a base of the device when axis of the holder mating block is perpendicular to the axis of the first shaft and plane of the target is parallel to the axis of the first shaft.

In one embodiment, a first face of the at least one of the faces of the frame unit acts as a base of the device when axis of the holder mating block and plane of the target are perpendicular to the axis of the first shaft.

In one embodiment, a second face of the at least one of the faces of the frame unit acts as a base of the device when axis of the holder mating block and plane of the target are parallel to the axis of the first shaft.

In one embodiment, a second shaft is configured in the frame unit, which is parallely connected to the first shaft, such that the first shaft drives the second shaft for rotating the second shaft for an angle greater than the first predetermined range of angle.

In one embodiment, first shaft and the second shaft are connected to each other by means selected from a group comprising toothed belts, chains, links and gears for obtaining slipless transmission between the first shaft and second shaft, wherein the means avoid slippage between the first shaft and second shaft while in operation.

In one embodiment, a second face of the at least one of the faces of the frame unit acts as a base of the device when the target is fixed to the second shaft using a removably connectable concentric target holder and axis of the holder mating block and plane of the target are co-axial with the axis of second shaft.

In one embodiment, the one or more slots are perpendicular and intersecting to each other.

FIG. 1*a* shows a perspective view of a frame unit (8) comprising a drive mechanism (28) with a first shaft (1) according to an embodiment of the present disclosure. Drive mechanism is but not limited to, "rack and pinion mechanism", "slider-crank mechanism", "magnetic drive mechanism", "planetary gears" and "worm gears". The frame unit (8) comprises more than one face and at least one of the faces is configured as a base for the device (20). In one embodiment, the frame unit (8) is having plurality of faces and is made of plurality of structural elements connected to each other to form the frame unit (8). In one embodiment, the frame unit (8) is but not limited to a cuboidal shaped, wherein four faces (F1, F2, F3 and F4) of the frame unit (8) is configured to have equal faces in rectangular shape and two square shaped faces [F5, and F6. The first shaft (1) of the drive mechanism (28) projects out of the face (F4) as shown in the figure.

FIG. 1*b* shows a perspective view of a frame unit (8) comprising a drive mechanism (28) which drives a first shaft (1) and additionally comprising a second shaft (2) connected to the first shaft (1) according to an embodiment of the present disclosure. Drive mechanism is but not limited to, "rack and pinion mechanism", "slider-crank mechanism", "magnetic drive mechanism", "planetary gears" and "worm gears". The first shaft and the second shaft are connected to each other by means selected from a group comprising but not limited to toothed belts, chains, links, gears or any other means which serves the purpose of slipless transmission between the first shaft (1) and the second shaft (2). In an embodiment, the first shaft (1) and second shaft (2) are connected in such a way that both the shafts (1, 2) rotate simultaneously and they are configured in a such a manner that, if first shaft (1) rotates by 90° then the second shaft (2) rotates by 180° from their initial position or if first shaft (1) rotates by 45° then the second shaft (2) rotates by 90° from their initial position. A single drive mechanism (28) is used to drive both the shafts. The speed of the second shaft (2) can be altered to that of speed of the first shaft (1) by altering driving interface between the first shaft (1) and second shaft (2).

FIGS. 2*a* and 2*b* shows a perspective view of targets (10) which are to be installed in the target holding bracket (6) (shown in FIG. 3 and FIGS. 4*a* and 4*b*) of the device (20) (shown in FIGS. 6 and 7) according to an embodiment of the present disclosure. The target (10) can be made of material which can withstand the piercing forces of the firing bullets. The target (10) is generally in 2D shaped plate structure; however, the target (10) can also be made in 3D silhouettes which would provide an impression of an actual target such as an enemy soldier. The 2D target may be made in shape but not limited to square, circular, oval, geometric and non-geometric shapes. In one embodiment, the target (10) can be of any size, shape, thickness and material (Flute Boards, self sealing, etc.). In one embodiment, the target (10) in the device (20) may provide night firing practice as the target (10) in the device (20) may be configured with an illuminating material by means such as but not limited to a light source affixed to the target (10). Also, the target (10) can be easily replaceable with new target, if damaged more during target practicing.

FIG. 3 shows a perspective view of an assembled view of a target holding bracket (6) and a holder mating block (5) according to an embodiment of the present disclosure. The holder mating block (5) is configured to be removably connected in desired slot of any one of the eccentric target holder (3) and concentric target holder (4) using a knob (7) to facilitate different directions or orientations of the target (10) which is fixed to it. Thereby, the eccentric target holder (3) provides the various movements of the target (10) namely swing, pop-up, slice and rotate up to 90°. The holder mating block (5) is removably connected to second end (6*b*) of the target holding bracket (6) using but not limited to fasteners, clamps and any other means or method which serve the purpose of joining. The shape of the target holding bracket (6) is made in such a way that, the target (10) may be easily conforming to the target holding bracket (6). The holder mating block (5) is provided with threaded holes which help in joining with the eccentric target holder (3) with a knob (7).

The holder mating block (5) is provided with threaded holes which help in joining with at least one of the eccentric target holder (3) and concentric target holder (4) with a knob (7).

FIGS. 4*a* and 4*b* shows a perspective view of an assembled view of the at least one target (10) which is removably connected with the target holding bracket (6) according to an embodiment of the present disclosure. At least one target (10) is removably connected to first end (6*a*) of the target holding bracket (6) using but not limited to fasteners, clamps and any other means or method which serve the purpose of holding the target (10) at desired location.

FIG. 5*a*: shows a perspective view of the eccentric target holder (3) according to an exemplary embodiment of the present disclosure. The eccentric target holder (3) is configured in such a way that the second end (3*b*) is offset at predetermined distance from the first end (3*a*) of the eccentric target holder (3). The first end (3*a*) is pivotable to the first shaft (1) axially such that the eccentric target holder (3) is rotatable about the axis (S-S) of the first shaft (1) (shown in FIG. 6) of the drive mechanism (28). The second end (3*b*) of the eccentric target holder (3) is configured with one or more slots (3*c*) in a predetermined manner such as but not limited to perpendicular and intersecting to each other, i.e. one slot ($3c_2$) is parallel to axis of the first shaft (1) and another slot (3*ci*) is perpendicular to axis of the first shaft (1) as shown in FIG. 5*b* which shows a magnified view of the portion "A" indicated in FIG. 5*a*. The second end (3*b*) of the eccentric target holder (3) is configured with a threaded hole (3*e*) and slots (3*ci* and $3c_2$) to accommodate profile of the holder mating block (5). In one embodiment, the holder mating block (5) is held rigidly in the any one of the slots (3*ci* and $3c_2$) using a knob (7) for joining.

FIG. 6 shows a perspective view of the device (20) comprising a first shaft (1) in an exploded view according to an embodiment of the present disclosure and FIG. 7 shows a perspective view of the device (20) as shown in the FIG. 6 in an assembled view. The device (20) is configured to provide gunnery training for trainees or shooters. The device (20) comprising a frame unit (8) configured to accommodate a drive mechanism (28) which is but not limited to, "rack and pinion mechanism", "slider-crank mechanism", "magnetic drive mechanism", "planetary gears" and "worm gears", wherein drive mechanism is configured to rotate a first shaft (1) within a first predetermined range of angle. The frame unit (8) comprises more than one face and at least one of the faces is configured as a base for the device (20). The device (20) further comprises at least one target holding bracket (6) removably connectable to at least one target (10) at first end (6*a*) and a holder mating block (5) at second end (6*b*). Also, at least one eccentric target holder (3) is removably connectable to the first shaft (1) at a first end (3*a*) and at least one holder mating block (5) at a second end (3*b*). The second end (3*b*) of the at least one eccentric target holder (3) comprises one or more slots (3*c*) in a predetermined pattern, such that the holder mating block (5) is placed in any one of the one or more slots (3*c*) for orienting plane of the at least one target (10) in at least one of parallel and perpendicular to the first shaft (1) for gunnery training. In one embodiment, the predetermined range of angle in which the first shaft (1) is ranging from about 0° to about 90°. In an exemplary embodiment, axis of the holder mating block (5) is indicated as H-H, which is perpendicular to axis (S-S) of the first shaft (1).

In one embodiment, the present disclosure also provides for a method of assembling the device (20). The method comprising acts of firstly, providing a frame unit (8) to accommodate a drive mechanism which is but not limited to, "rack and pinion mechanism", "slider-crank mechanism", "magnetic drive mechanism", "planetary gears" and "worm gears" (28), wherein drive mechanism is configured to rotate a first shaft (1) within a first predetermined range of angle, wherein the frame unit (8) comprises more than one face and at least one of the faces is configured as a base for the device (20). Secondly, removably connecting at least one target holding bracket (6) to the target at first end (6*a*) and a holder mating block (5) at second end (6*b*). Thirdly, removably connecting at least one eccentric target holder (3) to the first shaft (1) at a first end (3*a*) and at least one holder mating block (5) at a second end (3*b*), wherein the second end (3*b*) of the at least one eccentric target holder (3) comprises one or more slots (3*c*) in a predetermined pattern, such that the holder mating block (5) is placed in any one of the one or more slots (3*c*) for orienting plane of the at least one target (10) in at least one of parallel and perpendicular to the first shaft (1) for gunnery training.

In one embodiment, a second shaft (2) is configured in the frame unit (8), which is parallely connected to the first shaft (1), such that the first shaft (1) drives the second shaft (2) for rotating the second shaft (2) for an angle greater than the first predetermined range of angle.

In one embodiment, first shaft and the second shaft are connected to each other by means selected from a group comprising toothed belts, chains, links and gears for obtaining slipless transmission between the first shaft and second shaft, wherein the means avoid slippage between the first shaft and second shaft while in operation.

In one embodiment, a second face (F2) of the at least one of the faces of the frame unit (8) acts as a base of the device (20) when the target (10) is fixed to the second shaft (2) using a removably connectable concentric target holder (4) and axis (H-H) of the holder mating block (5) and plane of the target (10) are co-axial with the axis (S2-S2) of the second shaft (2).

In one embodiment, the device (20) may be configured to be placed on a trolley (not shown) for linear movement or any other movement conforming to a track (not shown). A drive mechanism can be configured to drive the trolley along the track at a predefined speed to provide horizontal motion (right and left) and head on-off motion (near and far). Both the functionality of the trolley and the device (20) may be controlled with remote control unit (not shown) or computer (not shown).

In one embodiment, a trainee or a firer fires a shot (either single slow shot, single shot rapid fire or a fully automatic fire) using a customized firing weapon preferably including, but not limited to pistol, rifle, sniper, SLR, Insas, and the like.

The technology of the present disclosure is further elaborated with the help of following examples. However, the examples should not be construed to limit the scope of the disclosure.

Example 1: Pop-Up and Pop-Down Motion

Figure 7A:
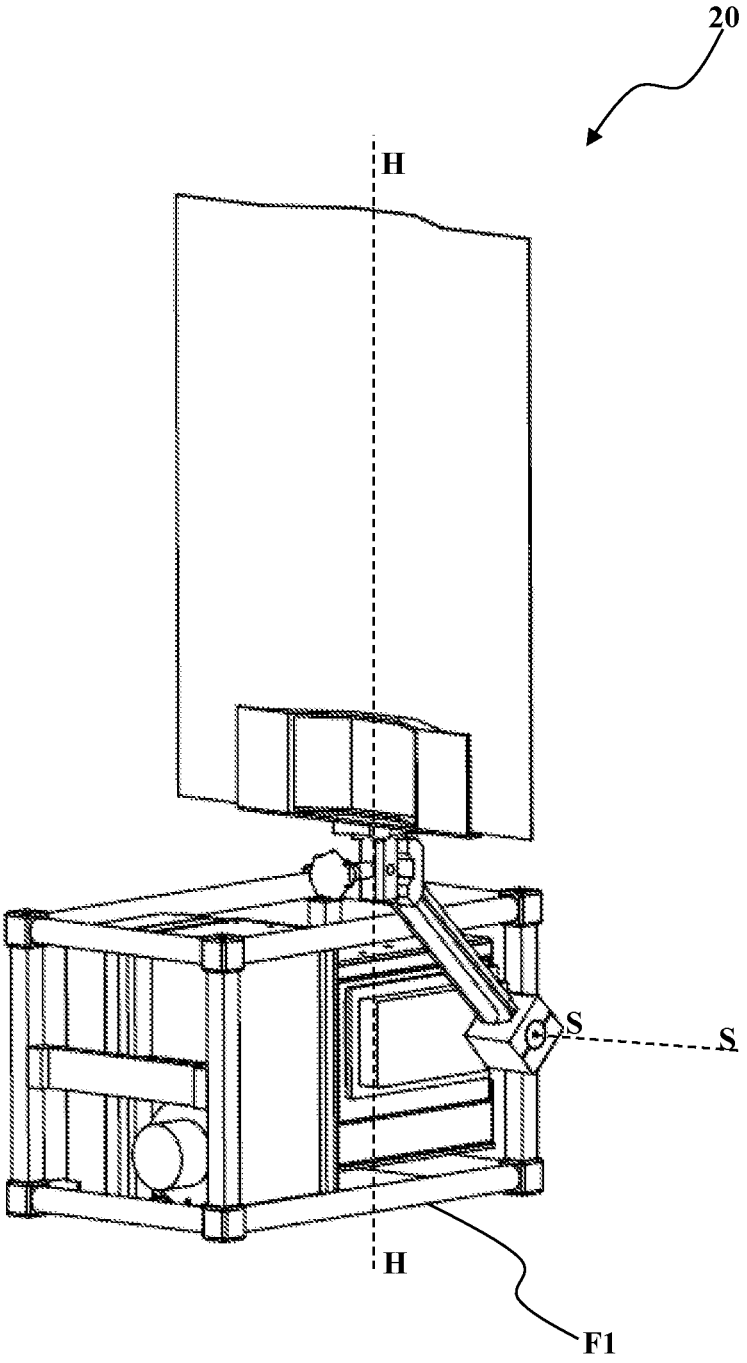
Figure 7B:
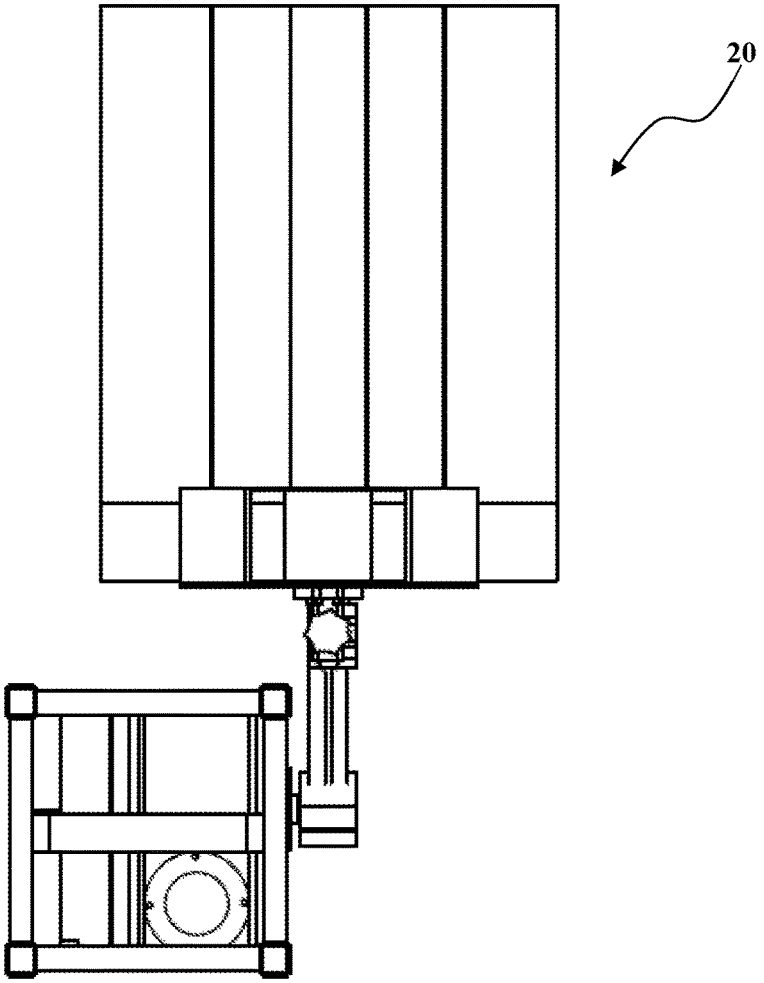
Figure 7C:
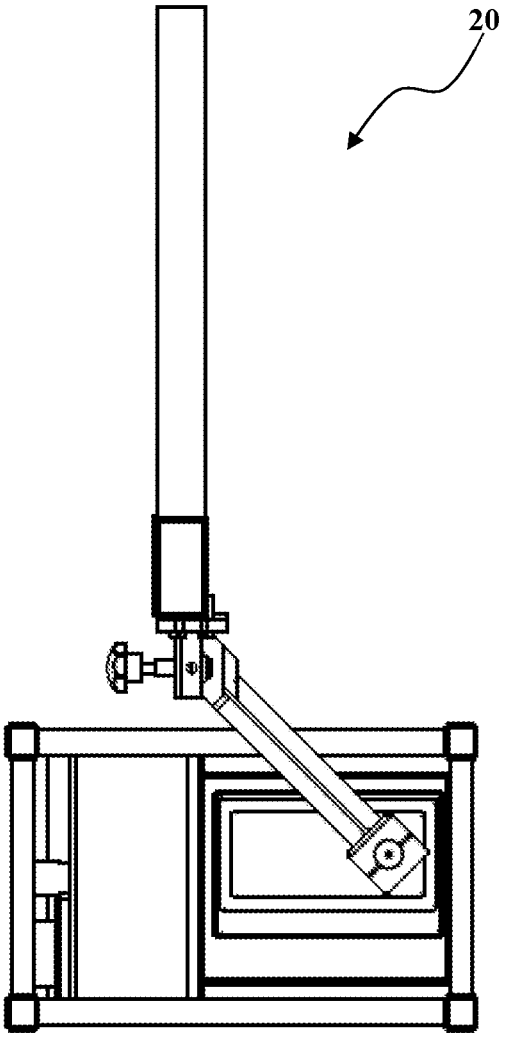
Figure 7D:
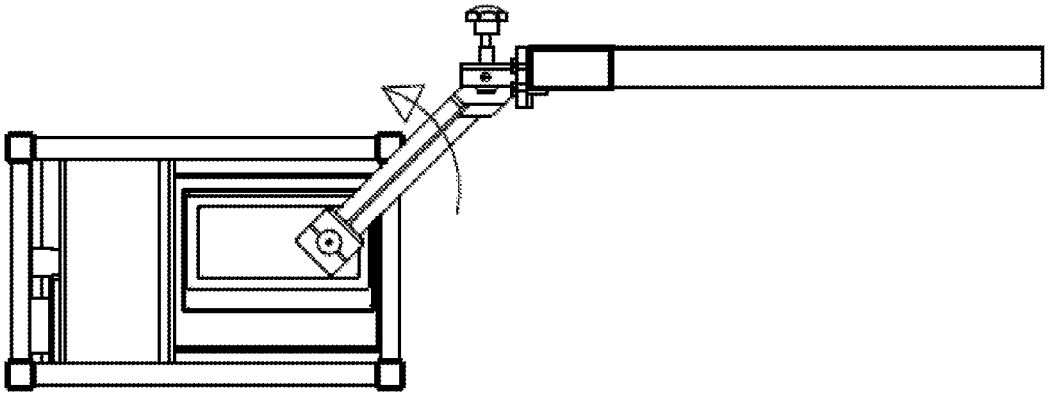

FIG. 7*a* shows front perspective view, 7*b* shows front view and 7*c* and 7*d* shows side views of an embodiment of the device (20) when target (10) is fixed to the first shaft (1) using an eccentric target holder (3) and a first face (F1) of the at least one of the faces of the frame unit (8) acts as a base of the device (20), and axis (H-H) of the holder mating block (5) is perpendicular to axis (S-S) of the first shaft (1) and plane of the target (10) is parallel to the axis (S-S) of the first shaft (1) according to an embodiment of the present disclosure. The "Plane" of the target (10) as herein used is an imaginary plane which is always parallel to the surface of the target (10) and facing the trainee or shooter.

The device (20) is configured to provide movement of the target (10) by pop-up and pop-down of the target (10). The term 'Pop-up' as used herein refers to raising of the target (10) and facing the target's front face (firing or shooting face) towards the trainee or shooter or firer. The term 'Pop-down' as used herein refers to lowering of the target (10) from the raised position and hiding behind the frame unit (8).

During the pop-up and pop-down movements of the target (10), direction of the device (20) is such that axis (S-S) of the first shaft (1) is horizontal (parallel to ground) and perpendicular to axis of firing. Also, the holder mating block (5) is to be placed in the perpendicular slot (3*ci*) (shown in FIG. 5*b*) of the eccentric target holder (3) and the direction of the target (10) facing towards the firer when it is at initial position i.e. pop-up position of the target (10), but when the first shaft (1) rotates by 90°, the target (10) pops-down.

Example 2: Swing Motion

FIGS. 8*a* to 8*c* shows front and top views of an embodiment of the device (20) when the target (10) is fixed to the first shaft (1) using the eccentric target holder (3) and a second face (F2) of the at least one of the faces of the frame unit (8) acts as a base of the device (20), and axis (H-H) of the holder mating block (5) and plane of the target (10) are parallel to the axis (S-S) of the first shaft (1) according to an embodiment of the present disclosure.

The device (20) is configured to provide swing motion or movement of the target (10) for training the trainees. "Swing motion or movement" herein refers to movement or rotation of the target (10) about axis (S-S) of the first shaft (1). For configuring the device (20) for swing movement, the holder mating block (5) is to be placed in parallel slot (3*$c_2$*) (shown in FIG. 5*b*) of the eccentric target holder (3) and the direction of the target (10) is facing towards the trainee or shooter or firer when it is at initial position (shown in the FIG. 8*c*) i.e. swing-in position of the target (10), but when the output shaft rotates by 90° (shown in the FIG. 8*b*), the target (10) swings-out i.e., only side edge (thick line) of the target (10) is visible to the trainee or shooter or firer.

Example 3: Slicing-Up and Slicing Down

FIGS. 9*a* to 9*c* shows front views and a side view of an embodiment of the device (20) when target (10) is fixed to the first shaft (1) using the removably connectable eccentric target holder (3) and a first face (F1) of the at least one of the faces of the frame unit (8) acts as a base of the device (20), and axis (H-H) of the holder mating block (5) and plane of the target (10) are perpendicular to the axis (S-S) of the first shaft (1) according to an embodiment of the present disclosure.

The device (20) is configured to provide movement of the target (10) by slicing-up and slicing-down of the target (10). The 'slicing-up' as used herein refers to movement of the target (10) sideways and above the frame unit (8) of the device (20) and facing the target's front face towards the trainee or firer. 'Slicing-down' as used herein refers to movement of the target (10) sideways and adjacent to the frame unit (8) of the device (20) and facing the target's front face towards the trainee or firer. For configuring the device (20) for slicing-up and slicing-down movements, the holder mating block (5) is to be placed in the slot (3*d*) of eccentric target holder (3) and the direction of the target (10) is facing towards the firer when it is at initial position i.e. slice-up position (shown in FIG. 9*a*) of the target (10), but when the first shaft (1) rotates by 90° from the initial position, the target (10) will slice-down (shown in FIG. 9*b*).

FIG. 10*a* shows a perspective view of the device (20) in an exploded view, wherein the device (20) further comprises a second shaft (2) parallel to the first shaft (1) according to an exemplary embodiment of the present disclosure. FIG. 10*b* shows a perspective view of the device (20) in FIG. 10*a* in an assembled view according to an exemplary embodiment of the present disclosure.

The device (20) comprises a second shaft (2) connected with a first shaft (1) of the drive mechanism (28) such that axis (S-S) of the first shaft (1) is parallel to axis (S2-S2) of the second shaft (2). The first shaft (1) drives the second shaft (2) to rotate the second shaft (2) for an angle greater than the first predetermined range of angle. In one embodiment, the second shaft (2) is configured to rotate in angle ranging from 0° to 180°. However, one skilled in art can understand that by changing the interface between the first shaft and second shaft, e.g. by changing gear ratio, one can achieve various range of angle variation in the second shaft (2). The example above should not be considered as a limitation.

In one embodiment, first shaft and the second shaft are connected to each other by means selected from a group comprising toothed belts, chains, links and gears for obtaining slipless transmission between the first shaft and second shaft, so that both the first and second shafts (1, 2) rotate simultaneously. In an exemplary embodiment, if the first shaft (1) rotates by 90°, then the second shaft (2) rotates by 180° from their initial position. In another exemplary embodiment, if the first shaft (1) rotates by 45°, then the second shaft (2) rotates by 90° from their initial position.

In one embodiment, the device (20) is capable to start and stop rotational movement from initial position to 45° and 90° of the first shaft (1) which is rotatable up to 90° and thereby rotating the second shaft (2) to 90° and 180° which is rotatable up to 180° and also capable of coming back to initial position in the opposite direction.

Example 4: Friend and Foe Movements

FIGS. 11*a* to 11*d* shows front and top views of an embodiment of the device (20) when the target (10) is fixed to the second shaft (2) using a removably connectable concentric target holder (4) and a second face (F2) of the at least one of the faces of the frame unit acts (8) as a base of the device (20) and axis (H-H) of the holder mating block (5) and plane of the target (10) are coaxial with the axis (S2-S2) of second shaft (2).

In this embodiment, the device (20) is configured to provide, as an example, 90° and 180° rotation of the target (10) with respect to second shaft (2) axis. The 90° and 180° rotation of the target (10) is referred as a friend and foe movements respectively. The target (10) is configured to have two faces, wherein one face shows friend, at which a firer should not fire at the target (10) and another face shows the enemy i.e., foe at which a firer is supposed to fire at the target (10).

The slot (4*a*) of the concentric target holder (4) is provided with a threaded hole (4*e*) (as shown in FIG. 10*a*) to accommodate profile of the holder mating block (5) rigidly using a knob (7)

Figure 11A:
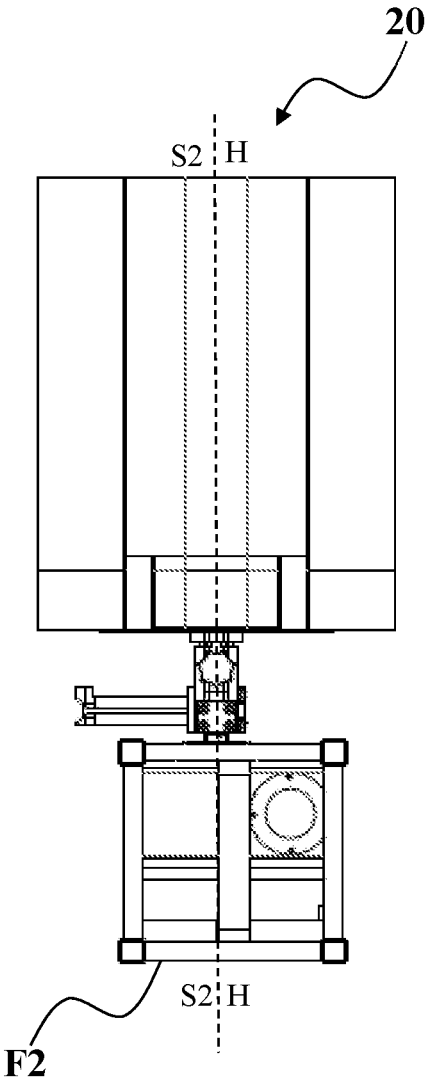
Figure 11B:
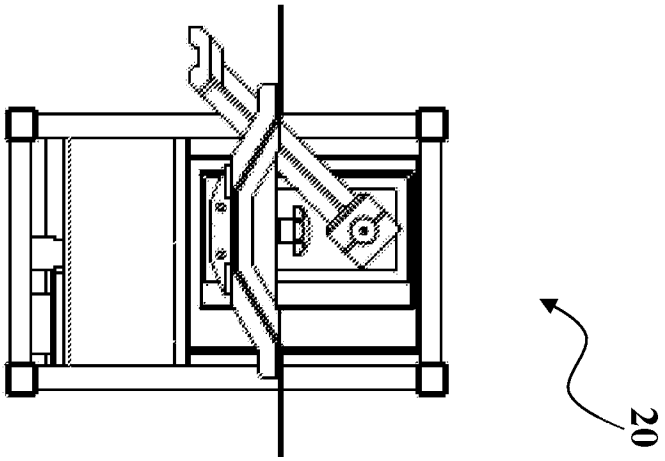
Figure 11C:
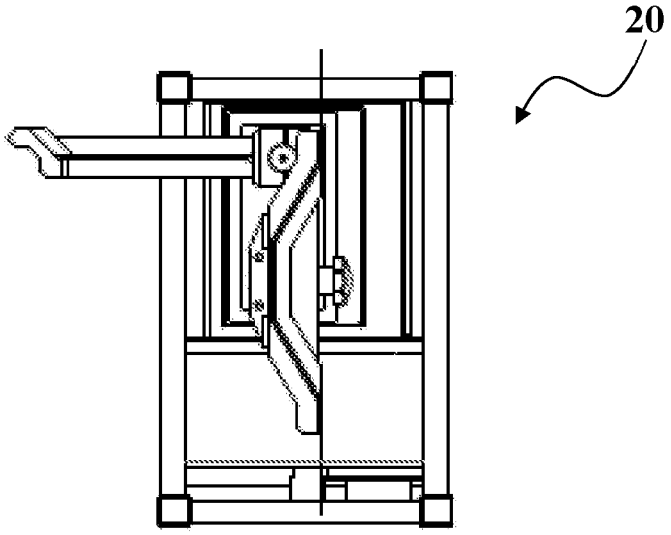
Figure 11D:
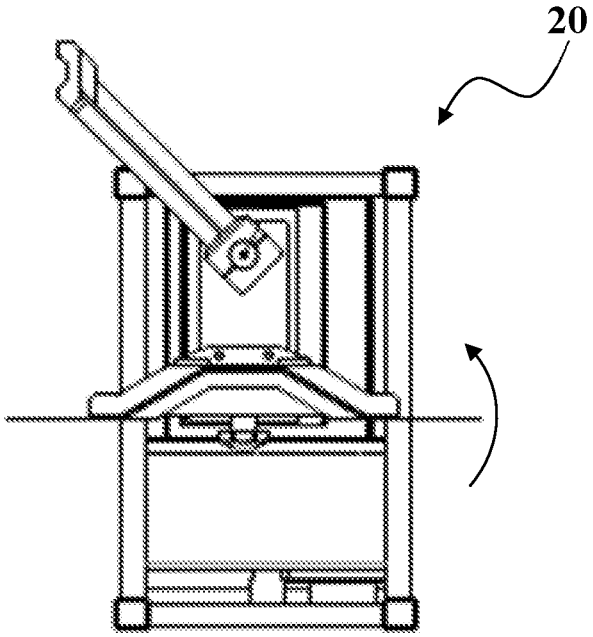

For configuring the device (20) to obtain friend and foe movements, the holder mating block (5) is to be placed in the slot (4*a*) of the concentric target holder (4) and the direction of the enemy faced side of the target (10) i.e., foe facing towards the firer when it is at initial position (as shown in top view FIG. 11*d*), but when the second shaft (2) rotates by 90° i.e., only side edge (thick line) of the target (10) is visible to the firer (as shown in top view FIG. 11*c*). And also when the second shaft (2) rotates by 180° i.e., friend face of the target (10) is visible to the firer as shown in top view FIG. 11*b*).

In one embodiment, the device (20) can be configured to achieve various movements by positioning device (20) and the holder mating block (5) in different directions and locations and also different movements can be explained with reference to the axis of firing (firer view/line of sight to fire), ground references.

In one embodiment, the eccentric target holder (3) connectable to first shaft (1) which is rotatable to about 90° from the initial position and configured to perform movements such as but not limited to swing, popup, slice and rotate. In one embodiment, the concentric target holder (4) is meant to perform rotational motion/movement, is fixed to second shaft (2) which is rotatable to 180° or in between 90° and 180° (referred as friend and foe movements of the target).

In one embodiment, the target holding bracket (6) is configured with a holder mating block (5). The holder mating block (5) is configured to be placed and removed in desired slot of any one of eccentric target holder (3) and concentric target holder (4) with a knob (7) to facilitate different directions of target which is fixed to it.

In one embodiment, the concentric target holder (4) is configured with one slot (4*a*) parallel to the axis of the second shaft (2) and a threaded hole to hold the holder mating block (5) rigidly. Thereby, plane of the target (10) is in line with the axis (S2-S2) of the second shaft (2) to achieve movements of the target (10) namely 90° rotation and 180° rotation.

In one embodiment the device (20) in examples illustrated above can be configured to be placed in adjacent to each other at various permutations and combinations and thereby a multi-lane firing system can be provided.

Advantages

In one embodiment, the device provides multi-lane firing system with one or more multifunctional devices for one or more trainees/firers, in which one or more multifunctional devices are controllable using remote control unit or computer.

In one embodiment, the target in the device provides night firing practice as the target in the device can be configured with an illuminating material by means of a light source affixed to the target.

In one embodiment, the device is easily configured to achieve four different movements with only one single eccentric target holder with a holder mating block consisting of a bracket and a knob. Further, friend and foe i.e., 180° rotation movement can be achieved by additional concentric target holder.

In one embodiment, the device for gunnery or fire training is portable in nature and the target movements may be programmed to remotely operated.

In one embodiment, the target can be configured into various movements such as Pop-up and Pop-down, Slice-up and Slice-down, Swing-in and Swing-out, Rotation at 0 degree, 90 degrees and 180 degrees.

In one embodiment, the device is more versatile and sophisticated, and imparts effective shooting/firing/gunnery practice and training among the trainees/firers.

In one embodiment, the device is capable of including, but not limited to recording single shot slow fire, single shot rapid fire and fully automatic fire.

In one embodiment, the design of the device is ruggedized to withstand rough usage and harsh weather.

In one embodiment, the targets are easily removable and with a very less effort and it can be fixed any of the first and second shafts for obtaining various configurations of the device and also, target exposure time can be set by the remote control unit or computer.

In one embodiment, the device is fully portable, battery operated and wirelessly controllable.

In one embodiment, the remote control unit or computer has a screen for displaying the data and for selecting different training exercises and also allows the user to control the functionalities of one or more device and/or trolley individually or collectively.

In one embodiment, the device is designed for use in both outdoor/indoor shooting ranges by virtue of its light weight, portability and easy operability and provides realistic environment for specialized training. The device can be adjustable for various types of infantry targets.

In one embodiment, the device is movable in nature. The device is mounted onto a trolley to move along a track at a predefined speed, and both the trolley and the device can be controllable using remote control unit or computer.

In one embodiment, the device in the present disclosure is lighter in weight, weather independent, capable of independent operation, relatively high reacting, capable of providing long term service with minimal maintenance, multifunction of the target and static target position.

In one embodiment, for providing different movements of the targets, the target is placed and fixed using only one kind of target holding bracket for all movements or positions.

INDUSTRIAL APPLICABILITY

The device as disclosed in this disclosure finds its potential application in providing gunnery or firing training for trainees. The device may however also find its application such as gaming device for kids using water guns or paint ball guns for recreational activities.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A device comprising:

a frame unit configured to accommodate a drive mechanism, which is configured to rotate a first shaft within a first predetermined range of angle, wherein the frame unit comprises more than one face and at least one of the faces is configured as a base for the device;

at least one target holding bracket removably connectable to at least one target at a first end and to a holder mating block at a second end; and at least one eccentric target holder removably connectable to the first shaft at a first end and at least one holder mating block at a second end, wherein the second end of the at least one eccentric target holder comprises one or more slots in a predetermined pattern, such that the holder mating block is placed in any one of the one or more slots for orienting a plane of the at least one target in at least one of parallel and perpendicular to the first shaft.

2. The device as claimed in claim 1, wherein a first face of the at least one of the faces of the frame unit acts as a base of the device when the axis of the holder mating block is perpendicular to the axis of the first shaft and the plane of the target is parallel to the axis of the first shaft.

3. The device as claimed in claim 1, wherein a first face of the at least one of the faces of the frame unit acts as a base of the device when the axis of the holder mating block and the plane of the target are perpendicular to the axis of the first shaft.

4. The device as claimed in claim 1, wherein a second face of the at least one of the faces of the frame unit acts as a base of the device when the axis of the holder mating block and the plane of the target are parallel to the axis of the first shaft.

5. The device as claimed in claim 1, wherein a second shaft is configured in the frame unit, which is parallely, connected to the first shaft, such that the first shaft drives the second shaft for rotating the second shaft for an angle greater than the first predetermined range of angle.

6. The device as claimed in claim 5, wherein the first shaft and the second shaft are connected to each other by means selected from a group comprising toothed belts, chains, links and gears for obtaining slipless transmission.

7. The device as claimed in claim 6, wherein a second face of the at least one of the faces of the frame unit acts as a base of the device when the target is fixed to the second shaft using a removably connectable concentric target holder and the axis of the holder mating block and the plane of the target are co-axial with the axis of second shaft.

8. The device as claimed in claim 1, wherein the one or more slots are perpendicular and intersecting to each other.

9. The device as claimed in claim 1, wherein the device is a gunnery training device, a target practicing device, or a gaming device.

10. A method of assembling a device, the method comprising:

providing a frame unit to accommodate a drive mechanism, which is configured to rotate within a first predetermined range of angle, wherein the frame unit comprises more than one face and at least one of the faces is configured as a base for the device; removably connecting at least one target holding bracket to at least one target at first end and a holder mating block at second end; and removably connecting at least one eccentric target holder to the first shaft at a first end and at least one holder mating block at a second end, wherein the second end of the at least one eccentric target holder comprises one or more slots in a predetermined pattern, such that the holder mating block is placed in any one of one or more slots for orienting a plane of the at least one target in at least one of parallel and perpendicular to the first shaft.

11. The method as claimed in claim 10, wherein a second shaft is configured in the frame unit, which is parallely connected to the first shaft, such that the first shaft drives the second shaft for rotating the shaft for an angle greater than the first predetermined range of angle.

12. The method as claimed in claim 10, wherein the target is fixed to the second shaft using at least one concentric target holder.

13. The method as claimed in claim 10, wherein a first face of the at least one of the faces of the frame unit acts as a base of the device when the axis of the holder mating block is perpendicular to the axis of the first shaft and the plane of the target is parallel to the axis of the first shaft.

14. The method as claimed in claim 10, wherein a first face of the at least one of the faces of the frame unit acts as a base of the device when the axis of the holder mating block and the plane of the target are perpendicular to the axis of the first shaft.

15. The method as claimed in claim 10, wherein a second face of the at least one of the faces of the frame unit acts as a base of the device when the axis of the holder mating block and the plane of the target are parallel to the axis of the first shaft.

16. The method as claimed in claim 10, wherein a second shaft is configured in the frame unit, which is parallely connected to the first shaft, such that the first shaft drives the second shaft for rotating the second shaft for an angle greater than the first predetermined range of angle.

17. The method as claimed in claim 16, wherein the first shaft and the second shaft are connected to each other by means selected from a group comprising toothed belts, chains, links and gears for obtaining slip less transmission.

18. The method as claimed in claim 17, wherein a second face of the at least one of the faces of the frame unit acts as a base of the device when the target is fixed to the second shaft using a removably connectable concentric target holder and the axis of the holder mating block and the plane of the target are co-axial with the axis of the second shaft.

19. The method as claimed in claim 10, wherein the method is a gunnery training method, a target practicing method, or a gaming method.

* * * * *